US011331717B2

(12) United States Patent
Sotozaki

(10) Patent No.: US 11,331,717 B2
(45) Date of Patent: May 17, 2022

(54) METHOD OF MANUFACTURING SEMI-SOLIDIFIED MOLTEN METAL

(71) Applicant: TOYOTA JIDOSHA KABUSHIKI KAISHA, Toyota (JP)

(72) Inventor: Shuji Sotozaki, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/072,766

(22) Filed: Oct. 16, 2020

(65) Prior Publication Data

US 2021/0252590 A1 Aug. 19, 2021

(30) Foreign Application Priority Data

Feb. 19, 2020 (JP) ..... JP2020-025968

(51) Int. Cl.
*B22D 27/00* (2006.01)

(52) U.S. Cl.
CPC ..... *B22D 27/003* (2013.01)

(58) Field of Classification Search
CPC ..... B22D 27/003; B22D 27/04; B22D 1/00; B22D 1/002
See application file for complete search history.

(56) References Cited

FOREIGN PATENT DOCUMENTS

JP 2017-521255 A 8/2017
WO WO 2015/174937 A1 11/2015

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A method of manufacturing semi-solidified molten metal includes a step of keeping discharging inert gas from a probe in a continuous manner, and inserting the probe into molten metal held at a temperature that is higher than a temperature of the probe and that is equal to or higher than a liquidus-line temperature, a step of extracting the inserted probe from the molten metal such that at least part of a region of a surface of the inserted probe that is in contact with the molten metal is exposed from the molten metal, and a step of inserting the extracted probe again into the molten metal.

2 Claims, 5 Drawing Sheets

METHOD OF MANUFACTURING SEMI-SOLIDIFIED MOLTEN METAL

CROSS-REFERENCE TO RELATED APPLICATION

This application claims priority to Japanese Patent Application N 2020-025968 filed on Feb. 19, 2020, incorporated herein by reference in its entirety.

BACKGROUND

1. Technical Field

The disclosure relates to a method of manufacturing semi-solidified molten metal, and more particularly, to a method of manufacturing semi-solidified molten metal through the use of a probe.

2. Description of Related Art

In a method of manufacturing semi-solidified molten metal disclosed in Japanese Unexamined Patent Application Publication (Translation of PCT Application) No. 2017-521255 (JP 2017-521255 A), a heat removal probe is inserted into molten metal, and inert gas is discharged into the molten metal through the heat removal probe. Solid nuclei are formed in the molten metal through stirring by the inert gas.

SUMMARY

The inventors of the disclosure of the present application found the following problem. There have been demands for a further enhancement of the capacity of semi-solidified molten metal. However, the quantity of formed solid nuclei does not increase even when the time for discharging inert gas is prolonged.

The disclosure aims at forming large-capacity semi-solidified molten metal.

A method of manufacturing semi-solidified molten metal according to the disclosure includes a step of keeping discharging inert gas from a probe in a continuous manner, and inserting the probe into molten metal held at a temperature that is higher than a temperature of the probe and that is equal to or higher than a liquidus-line temperature, a step of extracting the inserted probe from the molten metal such that at least part of a region of a surface of the inserted probe that is in contact with the molten metal is exposed, and a step of inserting the extracted probe again into the molten metal.

According to this configuration, the probe that is lower in temperature than the molten metal is inserted into the molten metal, and the molten metal that has come into contact with the surface of the probe is solidified to form a film on the surface of the probe. The film becomes solidified nuclei, and these solidified nuclei are dispersed into the molten metal. After that, the probe is extracted and inserted again into the molten metal, and the molten metal that has come into contact with the probe is solidified to form a film again on the surface of the probe. The film formed again becomes solidified nuclei, and these solidified nuclei are dispersed into the molten metal. Solidified nuclei are produced in large quantity and also homogeneously dispersed into the molten metal, so large-capacity semi-solidified molten metal can be formed.

Besides, the entire region of the surface of the inserted probe that is in contact with the molten metal may be exposed from the molten metal, in the step of extracting the inserted probe from the molten metal such that at least part of the region of the surface of the inserted probe that is in contact with the molten metal is exposed from the molten metal.

According to this configuration, after the entire region of the surface of the probe that is in contact with the molten metal is exposed from the molten metal, the probe is inserted again into the molten metal. Therefore, the volume of the film formed again on the surface of the probe increases. The film that has increased in volume becomes the solidified nuclei, and these solidified nuclei are dispersed into the molten metal. That is, the capacity of semi-solidified molten metal can be further enhanced by increasing the production quantity of solidified nuclei.

The disclosure makes it possible to form large-capacity semi-solidified molten metal.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

The concrete embodiments to which the disclosure is applied will be described hereinafter in detail with reference to the drawings. It should be noted, however, that the disclosure is not limited to the following embodiments. Besides, for the sake of clear explanation, the following description and drawings are simplified as appropriate.

First Embodiment

Figure 1:
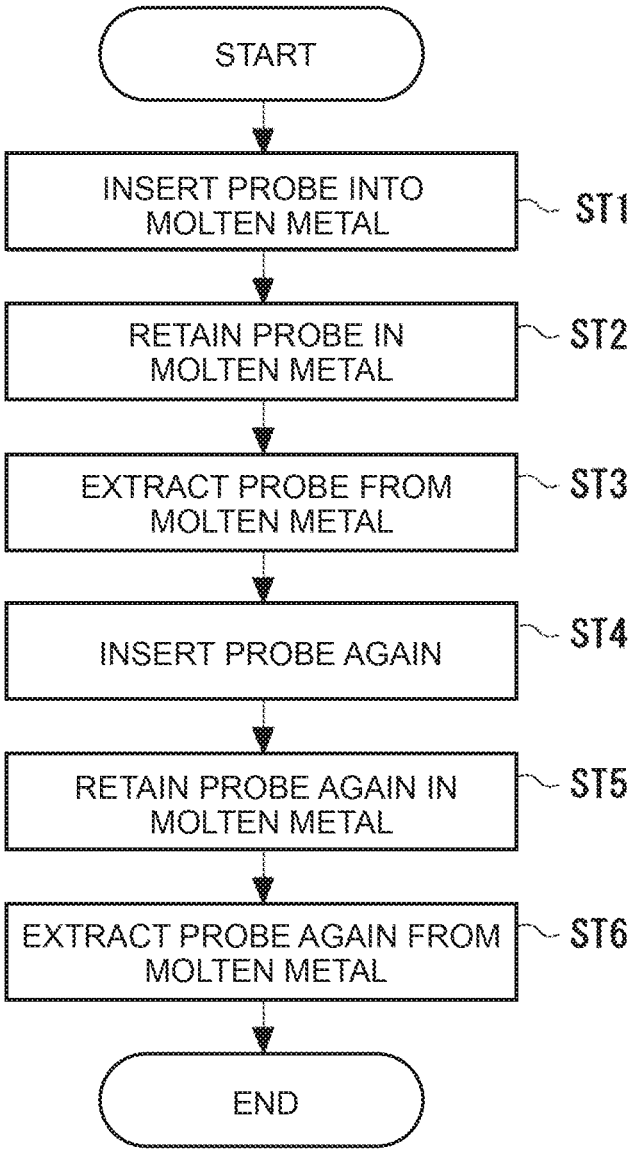
FIG. 1 is a flowchart showing an example of a method of manufacturing semi-solidified molten metal according to the first embodiment.

The first embodiment will be described with reference to FIGS. 1 to 7. FIG. 1 is a flowchart showing an example of a method of manufacturing semi-solidified molten metal according to the first embodiment. Each of FIGS. 2 to 7 is a schematic view showing a process of the example of the method of manufacturing semi-solidified molten metal according to the first embodiment. For the sake of understandability, an inert gas supply device 3 is not shown in FIGS. 3 to 7.

Incidentally, as a matter of course, a right-hand XYZ coordinate system shown in each of FIG. 1 and other drawings is used for the sake of convenience to explain a positional relationship among components. In general, as is common among the drawings, the positive direction along a Z-axis represents a vertically upward direction, and an XY plane represents a horizontal plane.

Figure 2:
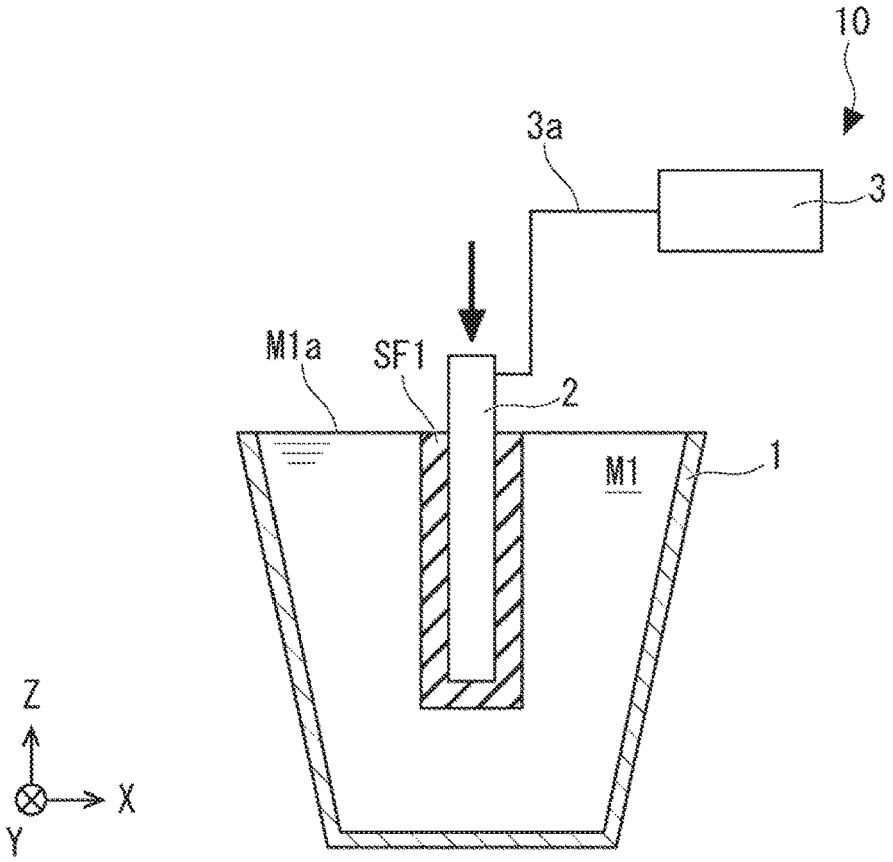
FIG. 2 is a schematic view showing a process of the example of the method of manufacturing semi-solidified molten metal according to the first embodiment.

As shown in FIG. 2, a probe 2 is inserted into molten metal M1 (in a probe insertion step ST1).

In the method of manufacturing semi-solidified molten metal according to the first embodiment, a device 10 can be used. The device 10 is equipped with a ladle 1, the probe 2, and the inert gas supply device 3. The ladle 1 retains the molten metal M1. After being heated to a temperature that is higher than a temperature of the probe 2 and that is equal to or higher than a liquidous-line temperature and retained by a molten metal retention furnace (not shown), the molten metal M1 is ladled by the ladle 1. The probe 2 is connected to the inert gas supply device 3 via a gas pipe 3*a*. The inert gas supply device 3 supplies inert gas to the probe 2 through the gas pipe 3*a*. Inert gas may be selected from a great variety of gases such as Ar and $N_2$. The inert gas supply device 3 is, for example, an $N_2$ gas production device. In concrete terms, inert gas is continuously discharged from the probe 2. The probe 2 can move while being gripped by, for example, a robot arm (not shown).

The probe 2 is inserted into the molten metal M1 by the robot arm or the like. The temperature of the probe 2 is lower than the temperature of the molten metal M1, so part of the molten metal M1 is cooled by coming into contact with a surface of the probe 2. Part of the cooled molten metal M1 is solidified, and a film SF1 is formed on the surface of the probe 2.

Figure 3:
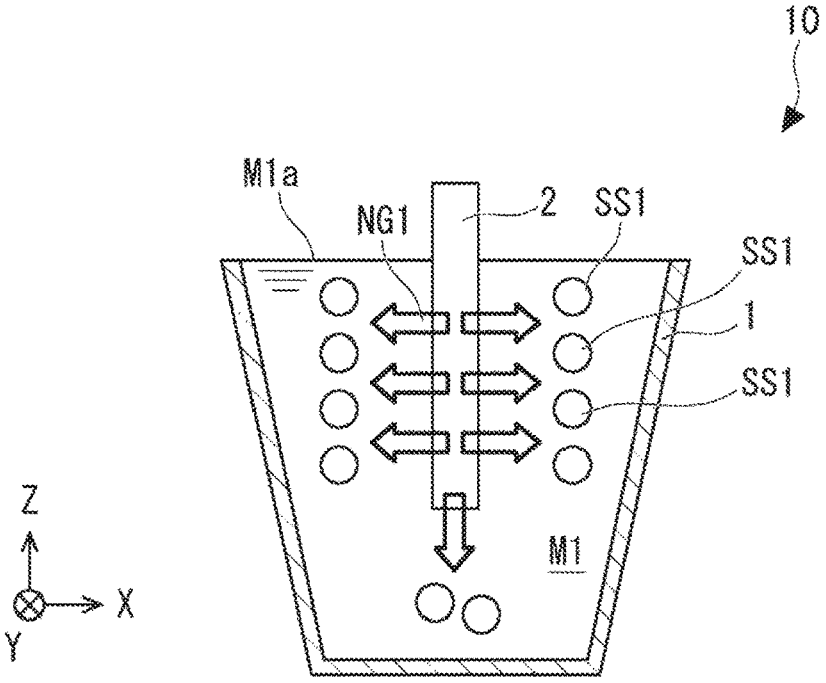
FIG. 3 is a schematic view showing another process of the example of the method of manufacturing semi-solidified molten metal according to the first embodiment.

Subsequently, as shown in FIG. 3, the probe 2 is retained for a predetermined time at a predetermined position in the molten metal M1 (in a probe retention step ST2). Inert gas NG1 is supplied from the probe 2 into the molten metal M1. The film SF1 shown in FIG. 2 becomes solidified nuclei SS1, and these solidified nuclei SS1 are dispersed into the molten metal M1.

Figure 4:
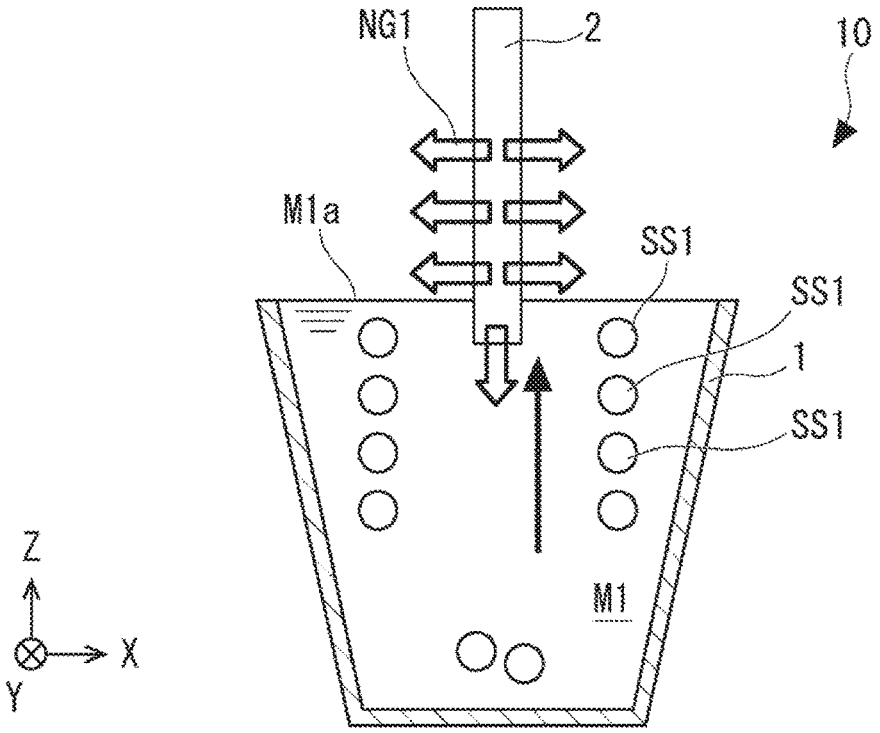
FIG. 4 is a schematic view showing still another process of the example of the method of manufacturing semi-solidified molten metal according to the first embodiment.

Subsequently, as shown in FIG. 4, the probe 2 is extracted from the molten metal M1 (in a probe extraction step ST3). In concrete terms, the probe 2 is extracted from the molten metal M1 such that at least part of a region of the surface of the probe 2 that is in contact with the molten metal M1 is exposed. Besides, the probe 2 may be extracted from the molten metal M1 until the entire region of the surface of the probe 2 that is in contact with the molten metal M1 is exposed.

Figure 5:
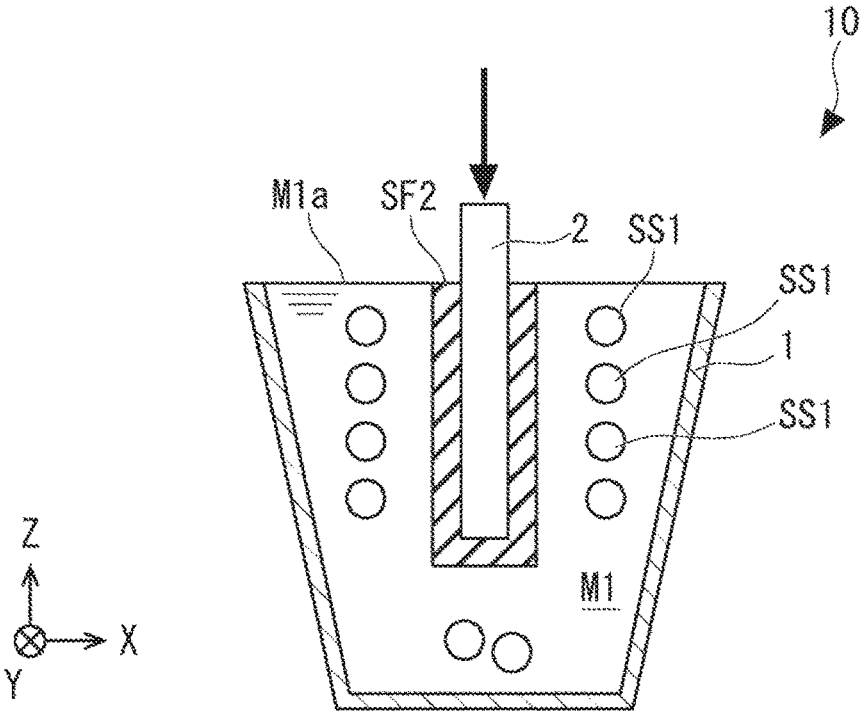
FIG. 5 is a schematic view showing still another process of the example of the method of manufacturing semi-solidified molten metal according to the first embodiment.

Subsequently, after the lapse of a predetermined time, the probe 2 is inserted again into the molten metal M1 as shown in FIG. 5 (in a probe re-insertion step ST4). In concrete terms, the predetermined time elapses while at least part of the region of the surface of the probe 2 that is in contact with the molten metal M1 is exposed. At least part of a lateral surface of the exposed probe 2 is cooled. The temperature of the probe 2 is lower than the temperature of the molten metal M1. Therefore, when the probe 2 is inserted again into the molten metal M1, part of the molten metal M1 is cooled by coming into contact with the surface of the probe 2. Part of the cooled molten metal M1 is solidified, and a film SF2 is formed on the surface of the probe 2.

Figure 6:
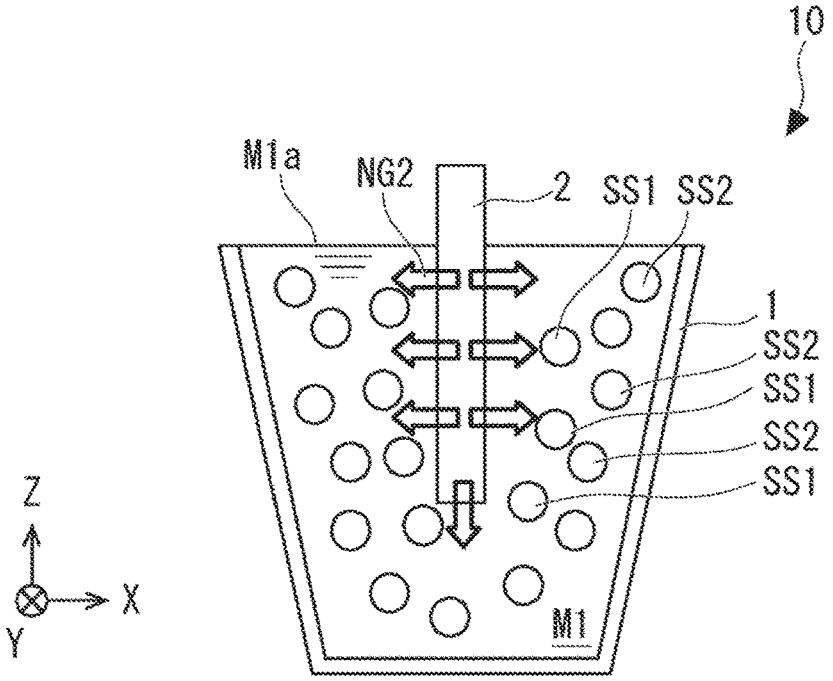
FIG. 6 is a schematic view showing still another process of the example of the method of manufacturing semi-solidified molten metal according to the first embodiment.

Subsequently, as in the probe retention step ST2, the probe 2 is retained again for a predetermined time at a predetermined position in the molten metal M1 as shown in FIG. 6 (in a probe re-retention step ST5). Inert gas NG2 is supplied into the molten metal M1 from the probe 2. The film SF2 shown in FIG. 5 becomes solidified nuclei SS2, and the solidified nuclei SS2 are dispersed into the molten metal M1. In addition to the solidified nuclei SS1 that have already been dispersed, the solidified nuclei SS2 are dispersed into the molten metal M1. Therefore, a large quantity of the solidified nuclei SS1 and a large quantity of the solidified nuclei SS2 are homogeneously dispersed into the molten metal M1.

Figure 7:
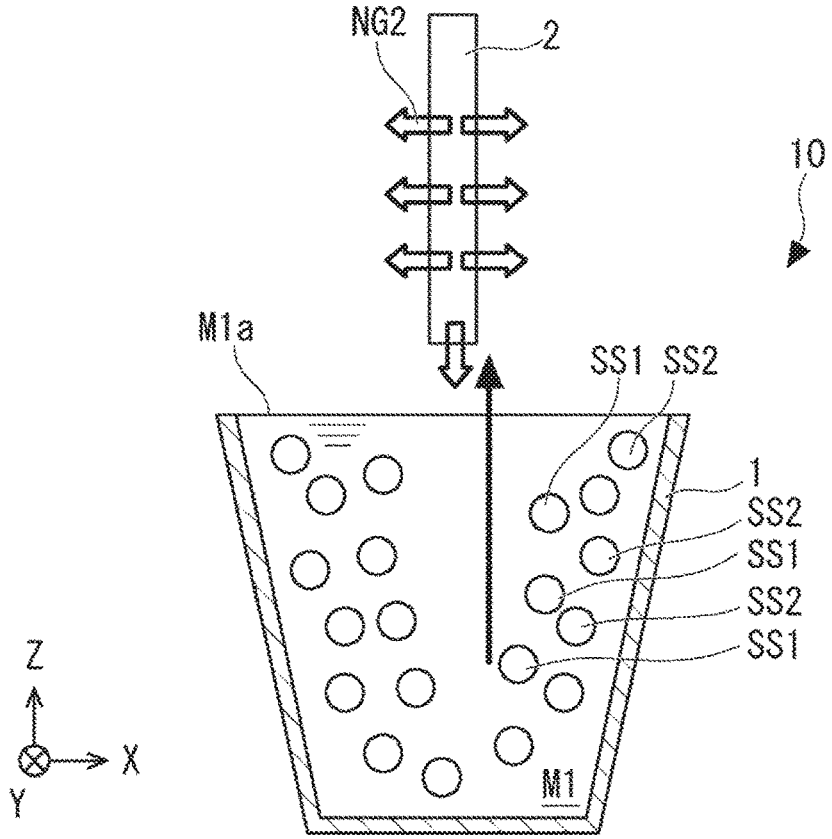
FIG. 7 is a schematic view showing still another process of the example of the method of manufacturing semi-solidified molten metal according to the first embodiment.

Finally, as shown in FIG. 7, the probe 2 is extracted again from the molten metal M1 (in a probe re-extraction step ST6). A large quantity of the solidified nuclei SS1 and a large quantity of the solidified nuclei SS2 are homogeneously dispersed in the molten metal M1. Therefore, large-capacity semi-solidified molten metal can be formed.

Owing to the foregoing, according to the aforementioned method of manufacturing semi-solidified molten metal, the probe 2 that is lower in temperature than the molten metal M1 is inserted into the molten metal M1, the molten metal M1 that has come into contact with the surface of the probe 2 is solidified, and the film SF1 is formed on the surface of the probe 2. The film SF1 becomes the solidified nuclei SS1, and the solidified nuclei SS1 are dispersed into the molten metal M1. After that, the probe 2 is extracted and inserted again into the molten metal M1, the molten metal M1 that has come into contact with the probe 2 is solidified, and the film SF2 is formed again on the surface of the probe 2. The film SF2 formed again becomes the solidified nuclei S52, and the solidified nuclei SS2 are dispersed into the molten metal M1. The solidified nuclei SS1 and the solidified nuclei SS2 are produced in large quantity, and are also homogeneously dispersed into the molten metal M1. Therefore, large-capacity semi-solidified molten metal can be formed.

Besides, according to the aforementioned method of manufacturing semi-solidified molten metal, the probe 2 may be extracted from the molten metal M1 until the entire region of the lateral surface of the probe 2 that is in contact with the molten metal M1 is exposed from a liquid surface M1*a* of the molten metal M1, in the probe extraction step ST3. In this case, the entire region of the lateral surface of the probe 2 that is in contact with the molten metal M1 is cooled by coming into contact With outside air. In consequence, the quantity of the film SF2 increases, and the quantity of the solidified nuclei SS2 increases. Accordingly, the capacity of semi-solidified molten metal can be further enhanced.

Embodiment Example

Figure 8:
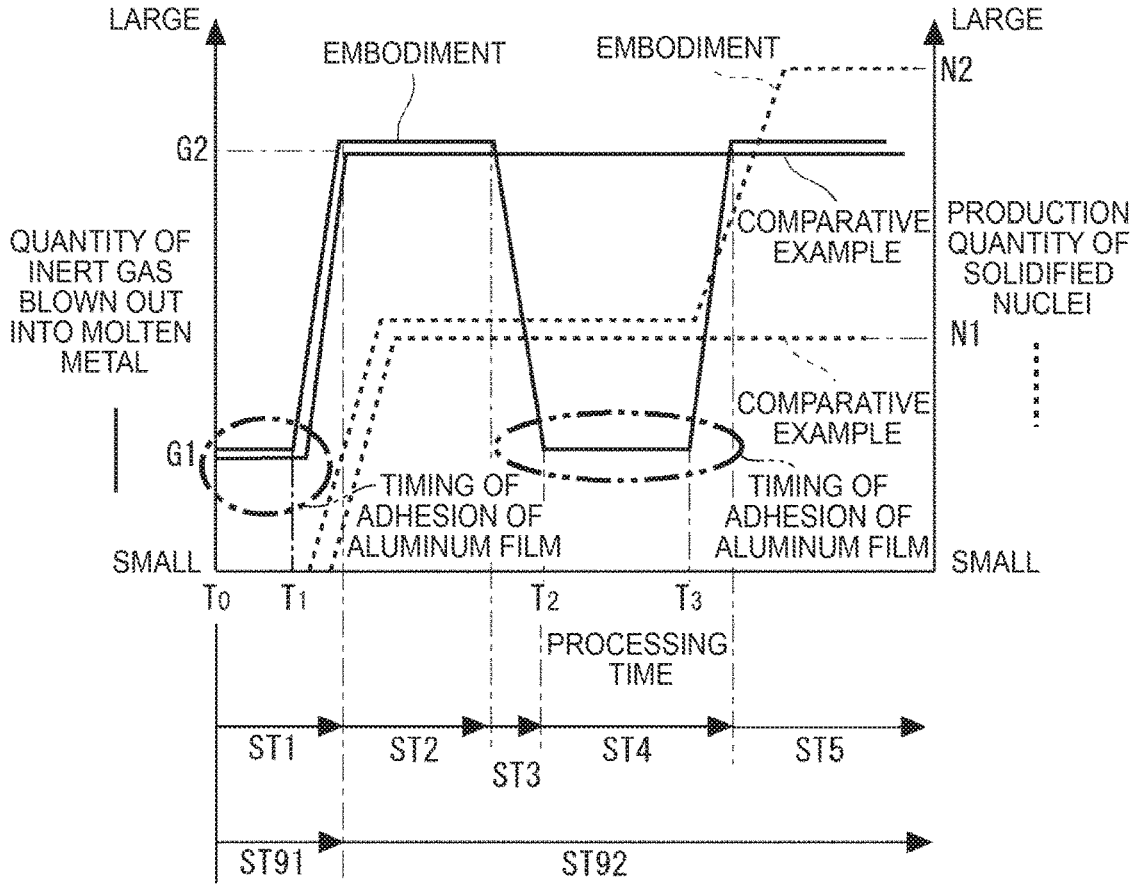
FIG. 8 is a graph showing a quantity of inert gas blown out into molten metal and a production quantity of solidified nuclei with respect to processing time.
Figure 9:
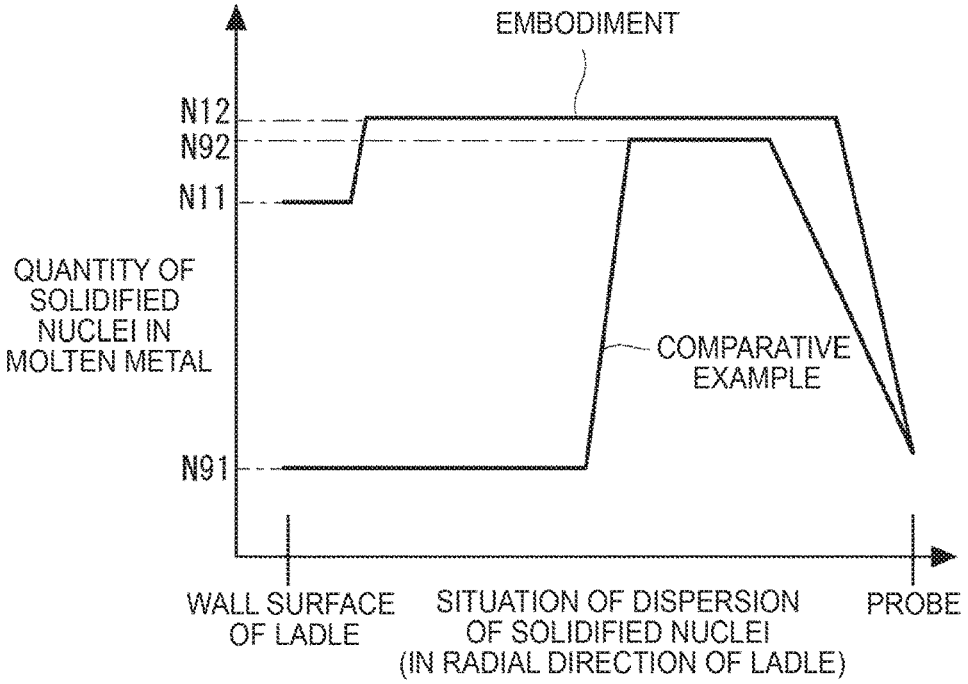
FIG. 9 is a graph showing a quantity of solidified nuclei flowing into molten metal in a radial direction of a ladle.

Next, the example of the method of manufacturing semi-solidified molten metal according to the aforementioned first embodiment will be described with reference to FIGS. 8 and 9, while making a comparison with a method of manufacturing semi-solidified molten metal according to the conventional art. FIG. 8 is a graph showing a quantity of inert gas blown out into molten metal and a production quantity of solidified nuclei with respect to a processing time. FIG. 9 is a graph showing a quantity of solidified nuclei dispersed into molten metal in the radial direction of the ladle.

In the method of manufacturing semi-solidified molten metal according to one of the embodiments of the aforementioned method of manufacturing semi-solidified molten metal, a predetermined manufacturing condition is set. Dissolved aluminum alloy for casting is used as the molten metal M1.

Incidentally, in the method of manufacturing semi-solidified molten metal according to the comparative example, a probe insertion step ST91, a probe retention step ST92, and a probe extraction step ST93 are successively carried out in this sequence. The probe insertion step ST91 is configured in the same manner as the probe insertion step ST1, the probe retention step ST92 is configured in the same manner as the probe retention step ST2, and the probe extraction step ST93 is configured in the same manner as the probe re-extraction step ST6. The time from a timing for starting the probe retention step ST92 to a timing for ending the probe retention step ST92 is as long as the time from a timing for starting the probe retention step ST2 to a timing for ending the probe re-retention step ST5.

FIG. 8 shows the quantity of inert gas blown out into molten metal and the production quantity of solidified nuclei with respect to the processing time as to the embodiment example and the comparative example. FIG. 9 shows the quantity of solidified nuclei dispersed into molten metal in the radial direction of the ladle.

As shown in FIG. 8, in the comparative example, an aluminum film is formed on the probe from a timing $T_0$ when the probe comes into contact with the liquid surface of molten metal to a timing $T_1$ when the blowout of inert gas into molten metal is started, in the probe insertion step ST91. The quantity of inert gas blown out into molten metal remains equal to a predetermined value G1 from the timing $T_0$ to the timing $T_1$. After that, the quantity of inert gas blown out into molten metal increases from the timing $T_1$ to a timing for ending the probe insertion step ST91, and reaches a predetermined value G2. Subsequently, the quantity of inert gas blown out into molten metal remains equal to the predetermined value G2 until the timing for ending the probe retention step ST92.

Besides, in the comparative example, the production quantity of solidified nuclei changes in such a manner as to follow the quantity of inert gas blown out into molten metal. In concrete tell is, the production quantity of solidified nuclei starts increasing with a slight delay from the timing $T_1$ in the probe insertion step ST91, and reaches a certain value N1 during the probe retention step ST92. Subsequently, the production quantity of solidified nuclei remains equal to the certain value N1 until the timing for ending the probe retention step ST92.

On the other hand, in the embodiment, the aluminum film is formed on the probe from the timing $T_0$ to the timing $T_1$. The quantity of inert gas blown out into molten metal remains equal to the predetermined value G1 from the timing $T_0$ to the timing $T_1$. After that, the quantity of inert gas blown out into molten metal increases from the timing $T_1$ to the timing for ending the probe insertion step ST1, and reaches the predetermined value G2. Subsequently, the quantity of inert gas blown out into molten metal remains equal to the predetermined value G2 until the timing for ending the probe retention step ST2, and decreases to the predetermined value G1 from a timing for starting the probe extraction step ST3 to a timing $T_2$ for ending the probe extraction step ST3. Subsequently, the aluminum film is formed on the probe from the timing $T_2$ for ending the probe extraction step ST3 to a timing $T_3$ for starting the blowout of inert gas into molten metal. The quantity of inert gas blown out into molten metal remains equal to the predetermined value G1 from the end timing $T_2$ to the timing $T_3$, then increases until a timing for ending the probe re-insertion step ST4, and reaches the predetermined value G2. Subsequently, the quantity of inert gas blown out into molten metal remains equal to the predetermined value G2 until the timing for ending the probe re-retention step ST5.

Besides, in the embodiment, the production quantity of solidified nuclei starts increasing with a slight delay from the timing $T_1$ in the probe insertion step ST1, and reaches the certain value N1 during the probe retention step ST2. Subsequently, the production quantity of solidified nuclei remains equal to the certain value N1 until the timing $T_3$ for starting the blowout of inert gas into molten metal, then increases until the timing for ending the probe re-insertion step ST4, and reaches a certain value N2. Subsequently, the production quantity of solidified nuclei remains equal to the certain value N2 until the timing for ending the probe re-retention step ST5.

In the probe extraction step ST3 and the probe re-insertion step ST4, the quantity of inert gas blown out into molten metal according to the embodiment example is smaller than the quantity of inert gas blown out into molten metal according to the comparative example. Besides, in the steps other than the probe extraction step ST3 and the probe re-insertion step ST4, the quantity of inert gas blown out into molten metal according to the embodiment example is almost equal to the quantity of inert gas blown out into molten metal according to the comparative example. In consequence, the quantity of inert gas blown out into molten metal according to the embodiment example is smaller than the quantity of inert gas blown out into molten metal according to the comparative example.

On the other hand, the production quantity of solidified nuclei according to the embodiment example is approximately equal to the production quantity of solidified nuclei according to the comparative example from the timing $T_0$ to the timing $T_3$, but is larger than the production quantity of solidified nuclei according to the comparative example from the timing $T_3$. In consequence, the production quantity of solidified nuclei according to the embodiment example is larger than the production quantity of solidified nuclei according to the comparative example.

As shown in FIG. 9, the quantity of solidified nuclei according to the comparative example increases to a predetermined value N92 from the probe toward a wall surface of the ladle, remains equal to the predetermined value N92 to a point between the probe and the wall surface of the ladle, but decreases to a predetermined value N91. The predetermined value N91 is much smaller than the predetermined value N92.

On the other hand, the quantity of solidified nuclei according to the embodiment example increases to a predetermined value N12 from the probe toward the wall surface of the ladle, and remains equal to the predetermined value N12 to the vicinity of the wall surface of the ladle. The quantity of solidified nuclei according to the embodiment example slightly decreases from the predetermined value N12 to a predetermined value N11 from the vicinity of the wall surface of the ladle to the wall surface of the ladle. The predetermined value N11 and the predetermined value N12 are not significantly different from each other. The predetermined values N11 and N12 are not significantly different from the predetermined value N92, but are much larger than the predetermined value N91. In consequence, the quantity of solidified nuclei according to the embodiment example is larger than the quantity of solidified nuclei according to the comparative example over the entire region in the radial direction of the ladle. Besides, the solidified nuclei according to the embodiment example are more homogeneously dispersed than the solidified nuclei according to the comparative example, because the quantity of solidified nuclei does not significantly change depending on the region in the radial direction of the ladle.

Owing to the foregoing, solidified nuclei are produced in lamer quantity in the embodiment example than in the comparative example. Besides, solidified nuclei are more homogeneously dispersed into the molten metal M1 in the embodiment example than in the comparative example. Therefore, large-capacity semi-solidified molten metal can be formed.

Incidentally, the disclosure is not limited to the foregoing embodiment, but can be appropriately altered within such a range as not to depart from the gist thereof. Besides, the disclosure may be carried out as an appropriate combination of the foregoing embodiment and an example thereof.

For instance, in the method of manufacturing semi-solidified molten metal according to the aforementioned first embodiment, the steps from the probe insertion step ST1 to the probe re-extraction step ST6 are carried out in this sequence. However, the steps from the probe insertion step ST1 to the probe re-retention step ST5, the steps from the probe extraction step ST3 to the probe re-retention step ST5, and the probe re-extraction step ST6 may be carried out in this sequence. Besides, among the steps from the probe insertion step ST1 to the probe re-retention step ST5, the steps from the probe extraction step ST3 to the probe re-retention step ST5, and the probe re-extraction step ST6, the steps from the probe extraction step ST3 to the probe re-retention step ST5 may be repeated a plurality of times. In these variations of the method of manufacturing semi-solidified molten metal, the steps from the probe extraction step ST3 to the probe re-retention step ST5 are carried out at least twice. Therefore, a larger quantity of solidified nuclei can be formed, and larger-capacity semi-solidified molten metal can be formed.

Besides, in the method of manufacturing semi-solidified molten metal according to the aforementioned first embodiment, the steps from the probe insertion step ST1 to the probe re-extraction step ST6 are carried out in this sequence. However, the probe retention step ST2 and the probe re-retention step ST5 may be omitted. In this method of manufacturing semi-solidified molten metal, the probe retention step ST2 and the probe re-retention step ST5 are not carried out, so large-capacity semi-solidified molten metal can be formed in a short time.

Besides, a valve may be provided midway in the gas pipe 3*a*. In the method of manufacturing semi-solidified molten metal according to the aforementioned first embodiment, inert gas is appropriately discharged from the probe 2. Inert gas may be appropriately discharged from the probe 2 through the opening/closing of the valve. For instance, inert gas is stopped from being discharged in the probe retention step ST2 and the probe re-retention step ST5, and inert gas is discharged in the probe insertion step ST1, the probe extraction step ST3, the probe re-insertion step ST4, and the probe re-extraction step ST6.

What is claimed is:

1. A method of manufacturing semi-solidified molten metal, the method comprising:

continuously discharging inert gas from a probe, and inserting the probe into molten metal held at a temperature that is higher than a temperature of the probe and that is equal to or higher than a liquidus-line temperature;

extracting the inserted probe from the molten metal such that at least part of a region of a surface of the inserted probe that is in contact with the molten metal is exposed from the molten metal;

inserting the extracted probe again into the molten metal; and at least partially solidifying the molten metal that comes into contact with the extracted probe that was inserted into the molten metal.

2. The method of manufacturing semi-solidified molten metal according to claim 1, wherein the entire region of the surface of the inserted probe that is in contact with the molten metal is exposed from the molten metal.

* * * * *